US006290581B1

(12) United States Patent
Dieck et al.

(10) Patent No.: US 6,290,581 B1
(45) **Date of Patent: *Sep. 18, 2001**

(54) AUTOMATIC MOWER REEL GRINDER

(75) Inventors: James H. Dieck, River Falls, WI (US); Roger Rosenquist, Rogers, MN (US)

(73) Assignee: Foley-Belsaw Company, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/476,830

(22) Filed: Jan. 3, 2000

Related U.S. Application Data

(63) Continuation of application No. 08/533,666, filed on Sep. 25, 1995, now Pat. No. 6,010,394, which is a continuation-in-part of application No. 29/038,087, filed on Apr. 28, 1995, now Pat. No. Des. 386,504.

(51) Int. Cl.[7] ..... B24B 3/00

(52) U.S. Cl. ..... 451/141; 451/421; 451/403; 451/9

(56) References Cited

U.S. PATENT DOCUMENTS

| | | |
|---|---|---|
| D. 250,196 | 11/1978 | Caccioli et al. . |
| D. 320,607 | 10/1991 | Smith et al. . |
| D. 386,504 | 11/1997 | Dieck . |
| 3,724,139 | 4/1973 | Leverez . |
| 4,005,554 | 2/1977 | Campbell . |
| 4,148,158 | 4/1979 | Hewitt . |
| 4,192,103 | 3/1980 | Sousek . |
| 4,621,456 | 11/1986 | Winstanley . |
| 4,694,613 | 9/1987 | Bernhard . |
| 4,741,130 | 5/1988 | Tano et al. . |
| 4,993,199 | 2/1991 | Hughes . |
| 5,012,617 | 5/1991 | Winstanley . |
| 5,291,724 | 3/1994 | Cotton . |
| 5,321,912 | 6/1994 | Neary et al. . |
| 5,333,112 | 7/1994 | Bybee . |
| 5,549,508 | 8/1996 | Searle et al. . |
| 5,879,224 | 3/1999 | Pilger . |
| 6,010,394 | 1/2000 | Dieck et al. . |

OTHER PUBLICATIONS

*Landpride Turf Reel Grinders* brochure, Landpride Turf, undated.

*Express Dual* brochure, Bernhard & Company Ltd., undated.

*Neary Spin–Matic II* brochure, Neary Manufacturing, copyright 1986.

*Ransomes Precision Grinders* brochure, Ransomes America Corporation, copyright 1994.

*The Key to the Manicured Look* brochure, Foley United, updated.

*For a Safer Grind!* Brochure, Foley United, undated.

*The Peerless 2000 Automatic Spin and Relief Grinder* brochure, Simple Ideal Peerless, undated.

*The Peerless 1360 Automatic Spin and Relief Grinder* brochure, Simplex Ideal Peerless, undated.

*Primary Examiner*—Joseph J. Hail, III
*Assistant Examiner*—George Nguyen
(74) *Attorney, Agent, or Firm*—Dorsey & Whitney LLP

(57) ABSTRACT

A grinding system (10) for sharpening the blades in cutting reels of mowing units incorporates an articulated grinding head (90) mounted for movement on a carriage (92). A unique index/guide assembly (160) is mounted on the grinding head (90). The index/guide assembly (160) includes a fixed guide finger (178) and associated movable index finger (180) for automatic sequential grinding of the blades in the spin grind mode.

26 Claims, 12 Drawing Sheets

AUTOMATIC MOWER REEL GRINDER

CROSS REFERENCE TO RELATED APPLICATIONS

This application is a continuation of application Ser. No. 08/533,666 filed Sep. 25, 1995, now U.S. Pat. No. 6,010,394 which is a continuation-in-part of application Ser. No. 29/038,087 filed Apr. 28, 1995, now U.S. Pat. No. Des. 386,504.

TECHNICAL FIELD

The present invention relates generally to machine tools. More particularly, this invention concerns a grinder system having a grinding head with a unique index/guide assembly for automatically sharpening helical blades in cutting reels of mowing units.

BACKGROUND ART

Commercial mowers typically utilize reel type mowing units which must be maintained regularly to assure proper operation. Part of such maintenance involves sharpening the blades and adjusting the bed knives. The sharpening process typically involves two steps: First spin grinding the tips or radial ends of the blades in order to 'true' the reel back to cylindrical shape, and then relief grinding the trailing edge of each blade in order to assure proper contact with the bed knife. This is a manually intensive, time consuming process.

Commercial grinders for this purpose have been available heretofore from Foley United, a division of the assignee hereof, Foley-Belsaw Company, and other manufacturers. However, the grinders of the prior art have typically required numerous and complex adjustments for proper setup, especially in the relief grind mode, depending upon the configuration of the particular mowing unit. Mowing units from different manufacturers have various sizes, number and size of blades, direction of blade twist, etc. As a result, it has been necessary to setup, adjust and then relief grind each blade in the reel of the mowing unit. This is labor intensive and time consuming. Also, it has usually been necessary to first remove the cutting reel from the mowing unit to access the blades for grinding.

More recently, improved grinders have become available. For example, U.S. Pat. No. 5,321,912 to Neary shows a mower reel blade relief grinding device incorporating on a common drive shaft separate slideable grinding wheels, one of which is used in the spin grind mode and the other being used in the relief grind mode. However, this device still requires complicated setup and re-adjustment on a blade-by-blade basis in the relief grind mode.

Heretofore, there has not been available a mower reel grinder which is adapted for automatic indexing so that each of the blades can be relief ground in sequence without further operator attention after initial setup.

SUMMARY OF INVENTION

The present invention comprises an automatic grinding system which overcomes the foregoing and other difficulties associated with the prior art. In accordance with the invention, there is provided an automatic grinder which is adapted for both spin grinding and relief grinding the blades in a cutting reel without necessarily removing the reel from the mowing unit. The grinder incorporates a grinding head mounted for travel on a carriage along a linear path extending parallel to the rotational axis of the cutting reel in the mowing unit, which is securely clamped in place. The grinding head is also mounted for movement on the carriage between spin and relief grind positions.

An index/guide assembly is mounted for compound movement on the grinding head according to the mode of operation. In the spin grind mode the index/guide assembly is positioned in an inoperative position as the carriage traverses the mowing unit to spin grind the ends of the blades. In the relief grind mode, the index/guide assembly is positioned in an operative position so that associated guide and index fingers can sequentially engage the blades as the carriage traverses the mowing unit to relief grind the trailing edge of each blade, automatically and without further operator attention after inital setup, until all of the blades in the cutting reel have sharpened. Adjustments are provided for adjusting the relief angle as desired.

BRIEF DESCRIPTION OF DRAWING

A better understanding of the invention can be had by reference to the following Detailed Description in conjunction with the accompanying Drawing, wherein.

DETAILED DESCRIPTION

Figure 1:
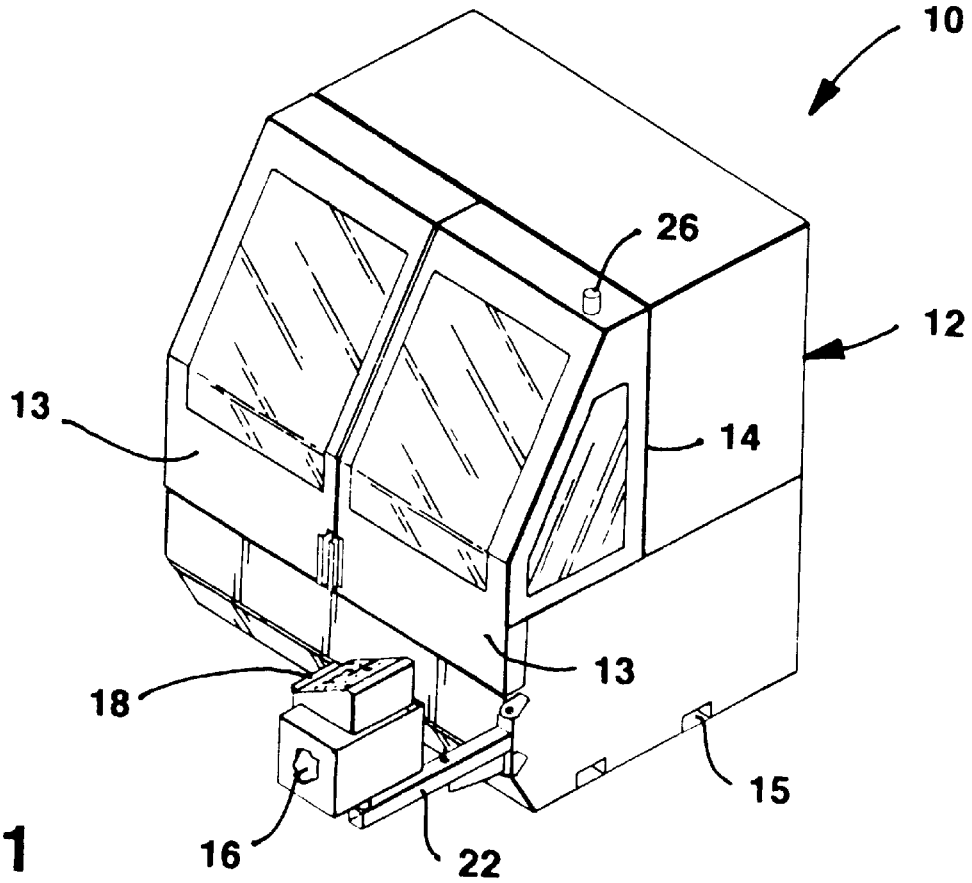
FIG. 1 is a perspective view of the automatic reel grinder incorporating the invention, shown with the doors closed.
Figure 2:
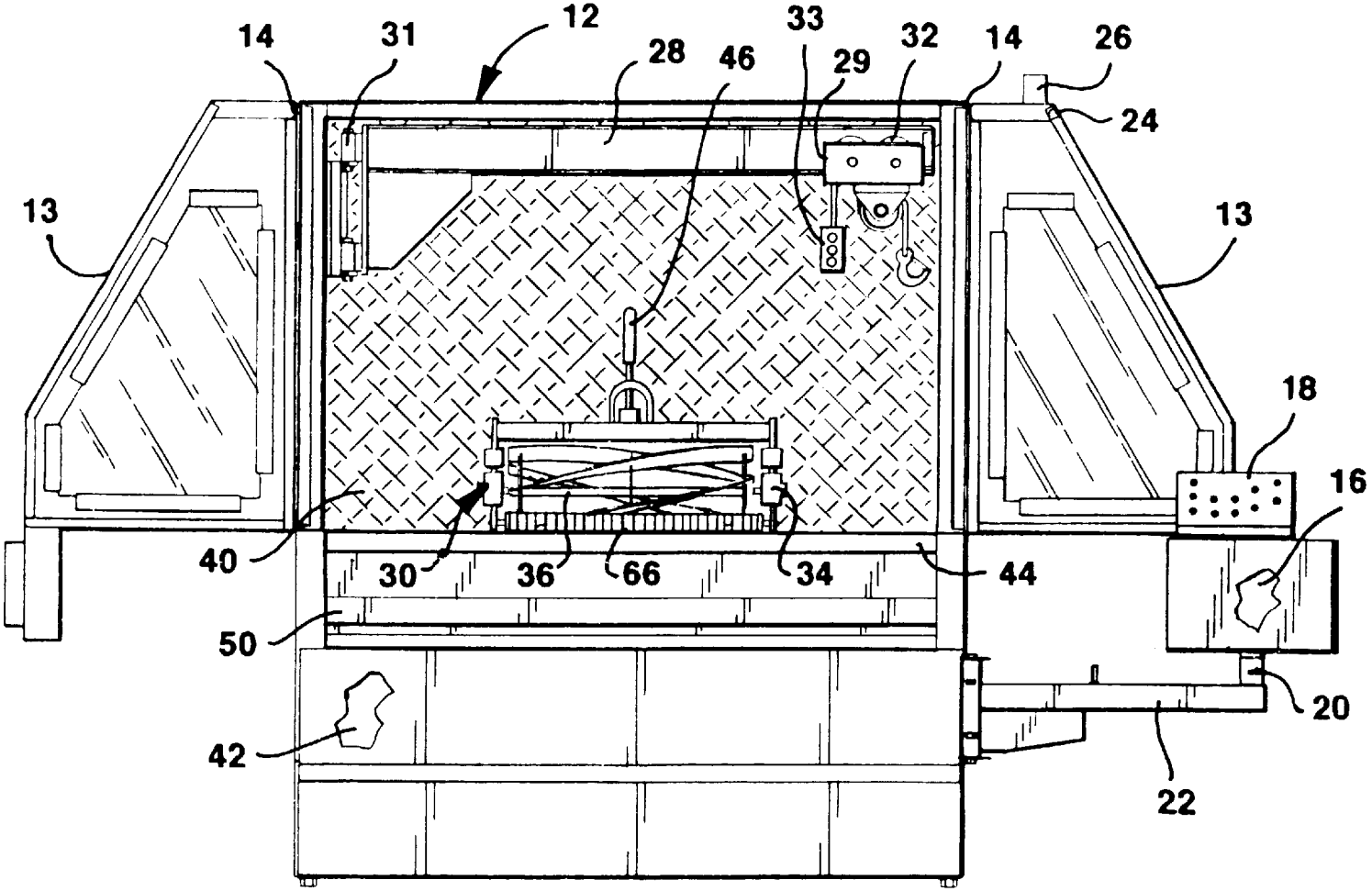
FIG. 2 is a front view of the automatic reel grinder herein, shown with the doors open.

Referring now to the Drawing, wherein like reference numerals designate like or corresponding elements throughout the views, and particularly referring to FIGS. 1 and 2, there is shown an automatic grinding system 10 incorporating the invention. As will be explained more fully hereinafter, the grinding system 10 incorporates an articulated grinding head with a unique index/guide assembly for either spin grinding or sequentially relief grinding the helical blades in cutting reels of mowing units on an automatic basis without manual attention after initial setup.

The grinding system 10 includes a surrounding enclosure 12 having a pair of front doors 13 mounted on hinges 14 for access to the interior of the enclosure. The doors 13 preferably include windows as shown for visually monitoring operation of the system 10 as desired. A pair of openings 15 are provided on the ends of the enclosure 12 so that system 10 can be relocated as desired by means of a forklift or other suitable device.

System 10 includes a microprocessor controller 16, the controls for which are located on a panel 18 on a swivel 20 at the end of a pivotal arm 22 attached to the enclosure 12. In the preferred embodiment, a sensor 24 is provided on one of the doors 13 to detect whether the doors are closed or open. A beacon 26 is also preferably provided on the top of enclosure 12 to signal when the system 10 has completed an operating cycle.

Turning now to the interior of the enclosure 12, a pivotal beam 28 and traveling hoist 29 are provided to facilitate transfer of a mowing unit 30 into and out of the system 10 for sharpening as necessary. The beam 28 is supported at one end for pivotal movement about a vertical hinge 31 between an extended position, and a retracted position inside the enclosure 12 as shown. The hoist 29 is supported by rollers 32 for travel along the pivotal beam 28 for positioning as necessary. A control box 33 is provided for controlling operation of the hoist 29 after it has been manually positioned along the beam 28. In the preferred embodiment, the hoist 29 comprises an electric winch, however, a manual winch or other suitable device could be used if desired.

The mowing unit 30 includes a frame 34 with a rotatable cutting reel 36 therein. The cutting reel 36 includes helical blades which swipe along and across a bed knife (not shown) for a shearing action. The blades in the cutting reel 36 can be spin ground and relief ground by system 10 without removal from the frame 34.

In the preferred embodiment, the interior of the enclosure 12 includes a sound deadening liner 40 for noise control. In addition, a dust collector 42 is preferably provided inside the enclosure 12.

Figure 3:
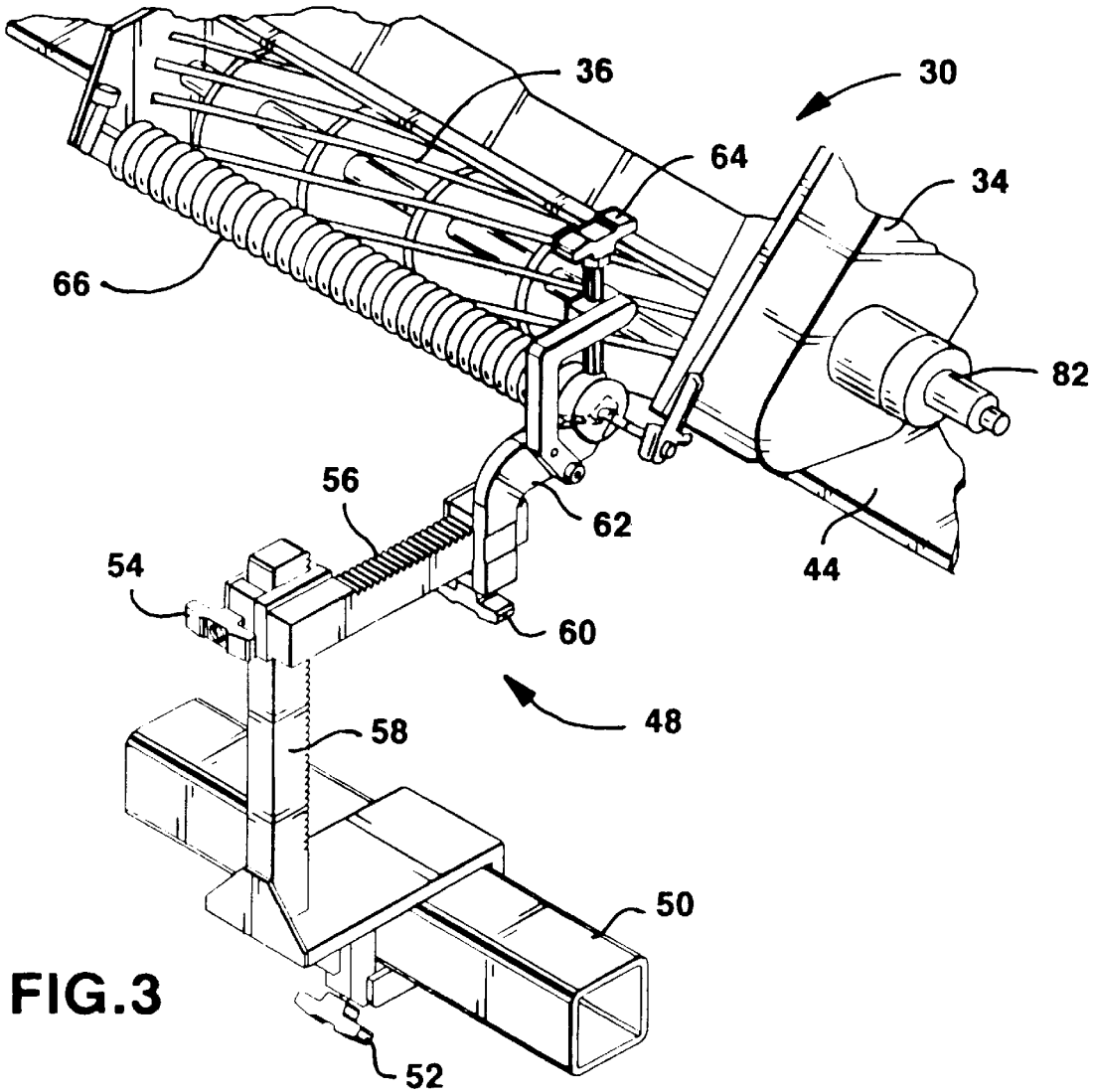
FIG. 3 is an illustration of the adjustable front cutting reel support.

During operation of the system 10, the mowing unit 30 is secured in a fixed position within the enclosure 12. In particular, the mowing unit 30 is partially supported on a shelf or ledge 44 and clamped down by means of a toggle clamp 46 as shown in FIG. 2. The front of the mowing unit 30 is secured by a pair of adjustable supports 48, only one of which is shown in FIG. 3, mounted on a transverse bar 50. The supports 48 have been omitted from FIG. 2 for clarity.

Referring to FIG. 3, each front support 48 provides for adjustable lateral, vertical and transverse positioning. Each support 48 includes a screw knob 52 for releaseably securing it in the desired position along the bar 50. Screw knob 54 is provided for securing the arm 56 in the desired vertical position on the base 58. Knob 60 is provided for securing the end 62 in the desired transverse position relative to the mowing unit 30, and screw knob 64 is provided for clamping the front roller 66 of the mowing unit 30 to the support. It will thus be understood that the back of the mowing unit 30 is partially supported on shelf 44 and releaseably secured by clamp 46, while the front of the unit is supported by a pair of laterally spaced apart supports 48 releaseably clamped to the front roller 66, or another suitable part of the mowing unit 30. The combination of a fixed rear support and adjustable front supports comprises a important feature of the invention because it allows more versatility in positioning during setup in accordance with the particular configuration of the mowing unit 30.

Figure 4:
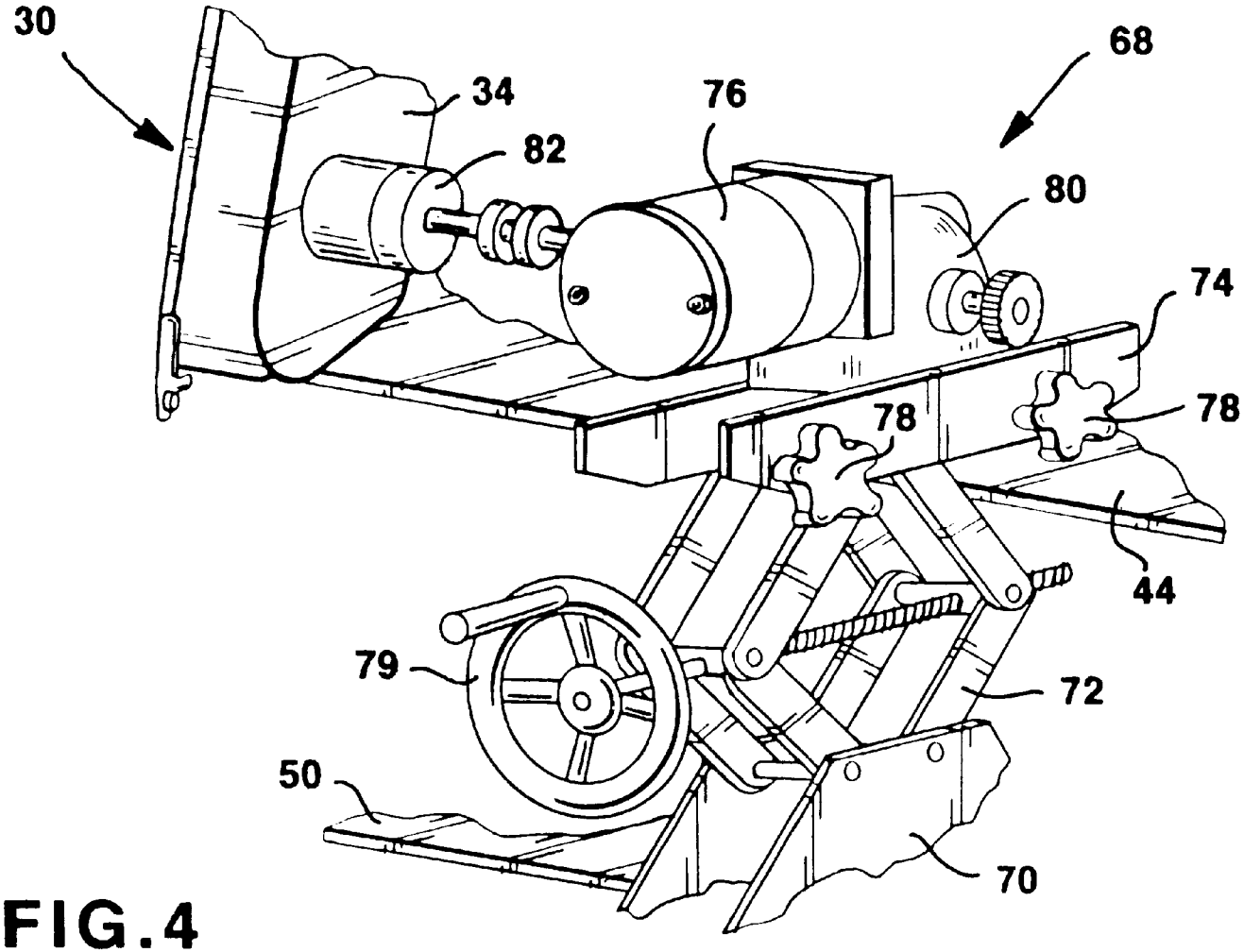
FIG. 4 is an illustration of the adjustable spin drive.

Referring to FIG. 4, system 10 includes a spin drive 68 for effecting rotation of the cutting reel 36 and blades in the mowing unit 30. The spin drive 68 is similarly adjustably mounted on the bar 50 on one side within the enclosure 12. In particular the spin drive 68 includes a base 70 connected by a linkage 72 to a member 74 to which the drive motor 76 is adjustably secured in the desired transverse position by means of screw clamps 78. Vertical positioning of the spin drive 66 is adjusted by means of wheel 79 and screw as shown. The motor 76 is connected via a right angle drive 80 and coupling 82 to the shaft supporting the cutting reel 36 of the mowing unit 30. The cutting reel 36 is normally driven counterclockwise when viewed from the right side.

Figure 5:
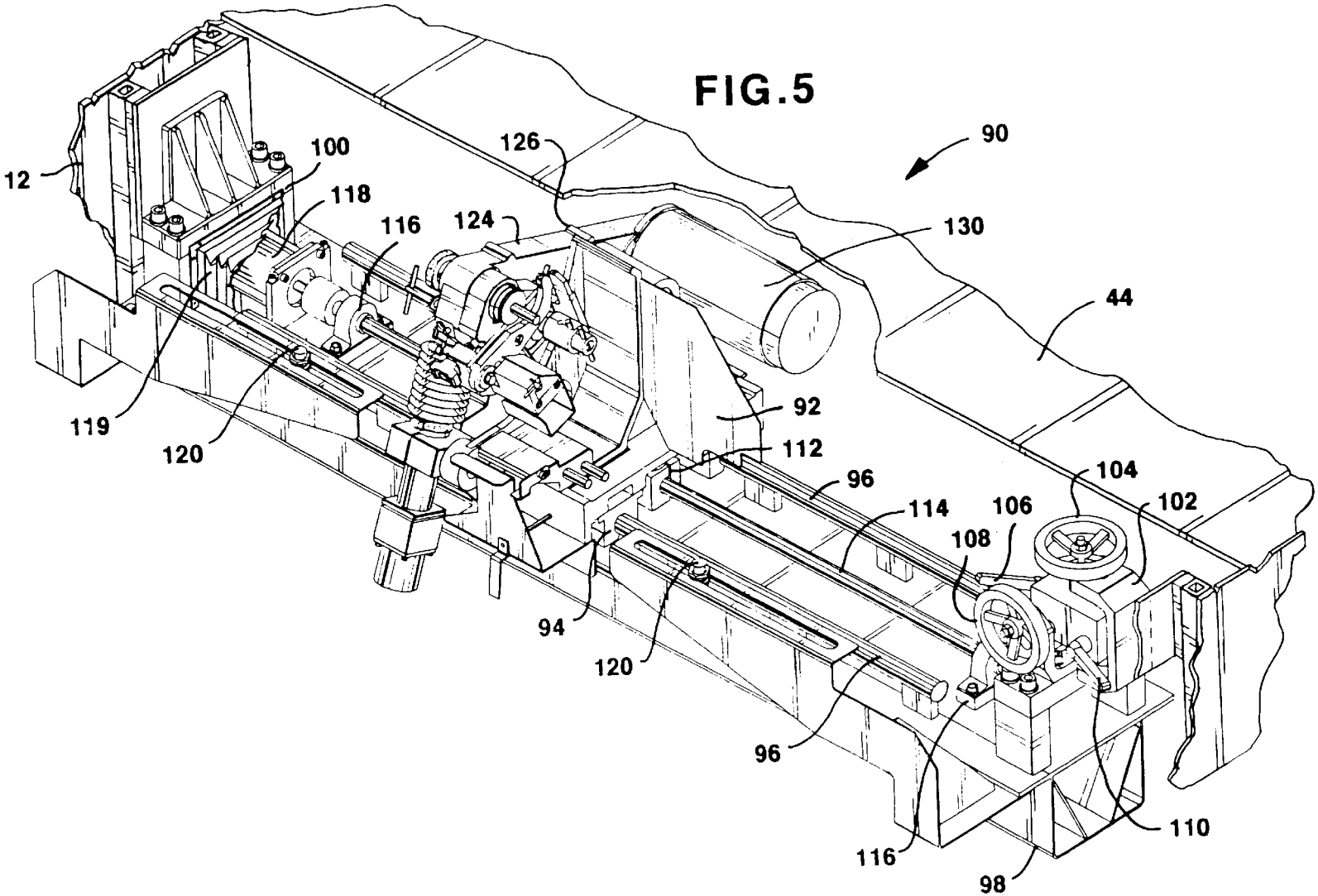
FIG. 5 is a perspective view of the movable carriage supporting the articulated grinding head.

Referring now to FIG. 5, a moveable grinding head 90 is provided for effecting first spin grinding of the blades in the mower cutting reel 36, and then effecting relief grinding of each individual blade in automatic sequential fashion. Various adjustments are provided so that the same grinding head 90 can be used in either mode without any changes except for the grinding wheel being used in each mode. A narrow grinding wheel is usually desired in the relief grind mode for clearance between the ends of the cutting reel 36 and frame 34 of mowing unit 30.

The grinding head 90 is supported on a carriage 92 which is moveable along a linear path parallel to the rotational axis of the cutting reel 36. In particular, the carriage 92 is supported on bearings 94 riding on guide rods 96. The guide rods 96 are secured to a subframe 98 which is supported within enclosure 12 for adjustment as necessary relative to the cutting reel 36 secured therein. One end of the subframe 98 is suspended by a flexible mounting 100. The other end of the subframe 98 is connected by an adjustable mounting 102 wherein vertical positioning is adjusted by wheel 104 and secured in place with lever 110, and horizontal positioning is adjusted with wheel 108 and secured in place by lever 106. The carriage 92 is connected to a traveling block 112 on a shaft 114 which is journaled for rotation between a pair of bearings 116 on the subframe 98. The shaft 114 is connected at one end to a drive motor 118 which thus controls reciprocal movement of carriage 92 along guide rods 96. The motor 118 is responsive to a pair of limit switches 120 which can be adjusted in accordance with the length or size of the particular mowing unit 30 being sharpened. The guide rods 96 and drive shaft 114 are preferably covered by bellows sections 119 connected between the respective side and the carriage 92 for dust protection.

Figure 6:
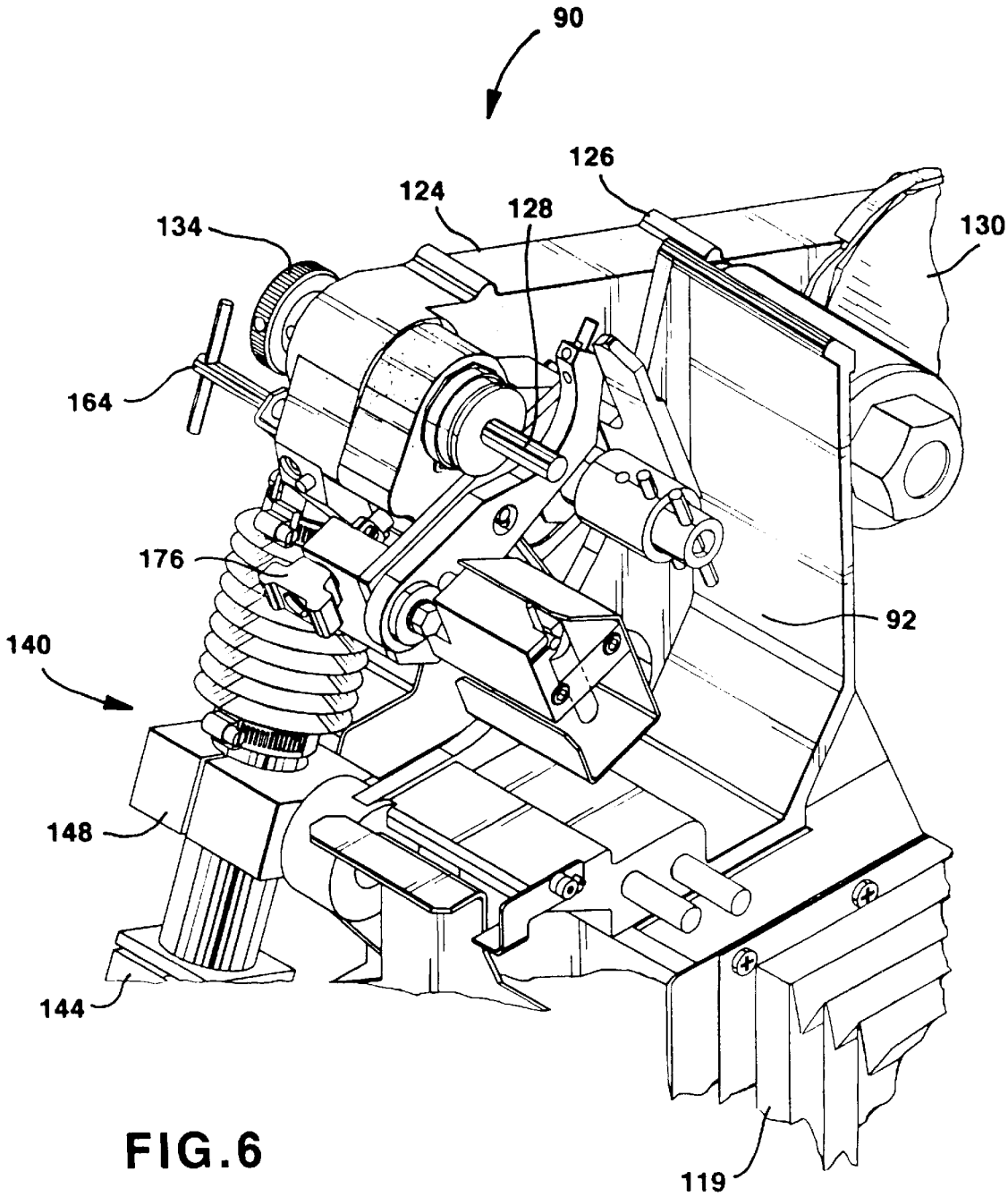
FIG. 6 is a perspective illustration of one side of the grinding head, showing the index/guide assembly thereon.
Figure 7:
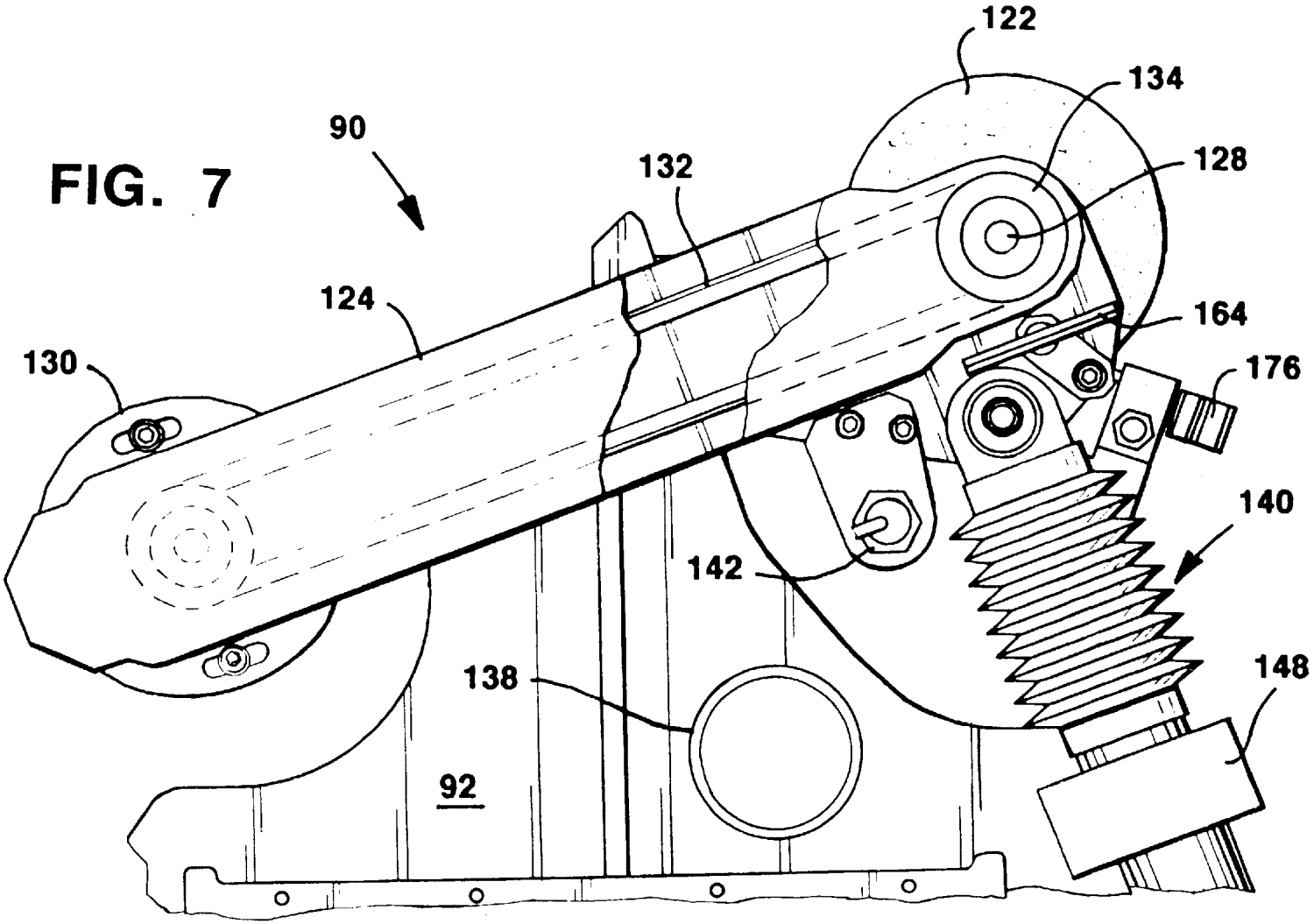
FIG. 7 is an illustration of the other side of the grinding head.

Referring to FIGS. 6 and 7, the grinding head 90 includes a grinding wheel 122 on a housing 124 which is supported on carriage 92 by pivot 126. For purposes of clarity, the grinding wheel 122 has been omitted from FIG. 6. The grinding wheel 122 is supported on a shaft 128 driven by motor 130 via a belt and pulley arrangement 132. A knob 134 is secured to one end of shaft 128 in order to stabilize the shaft when turning the knob 136 on the other end (shown in FIG. 10) when changing grinding wheel 122. The inlet 138 of dust collector 42 can be connected directly to carriage 92 for dust removal during operation of system 10.

It will thus be appreciated that the housing 124 is supported on the carriage 92 for pivotal movement about an axis which is parallel to the rotational axis of the blades in reel of the mowing unit 30. This allows for movement of the grinding wheel 122 in a transverse direction toward and away from the mowing unit 30, which in turn allows for versatility depending upon the size of the grinding wheel and the size and configuration of the particular mowing unit 30.

Vertical positioning of the grinding head 90 on carriage 92 is controlled by an actuator 140 responsive to a sensor 142 which senses positioning in the relief grind position. Another sensor senses positioning of the grinding head in the spin grind position. Any suitable linear actuator can be used for actuator 140. In the preferred embodiment, the actuator 140 comprises a stepper motor 144 driving telescoping threaded tubes 146, the outer one of which is secured to a block 149 pivoted to the carriage 92 and the inner one of which is coupled to the housing 124 as shown. Such actuators can be obtained from Tol-O-Matic, Inc. of Minneapolis, Minn., for example.

Figure 8:
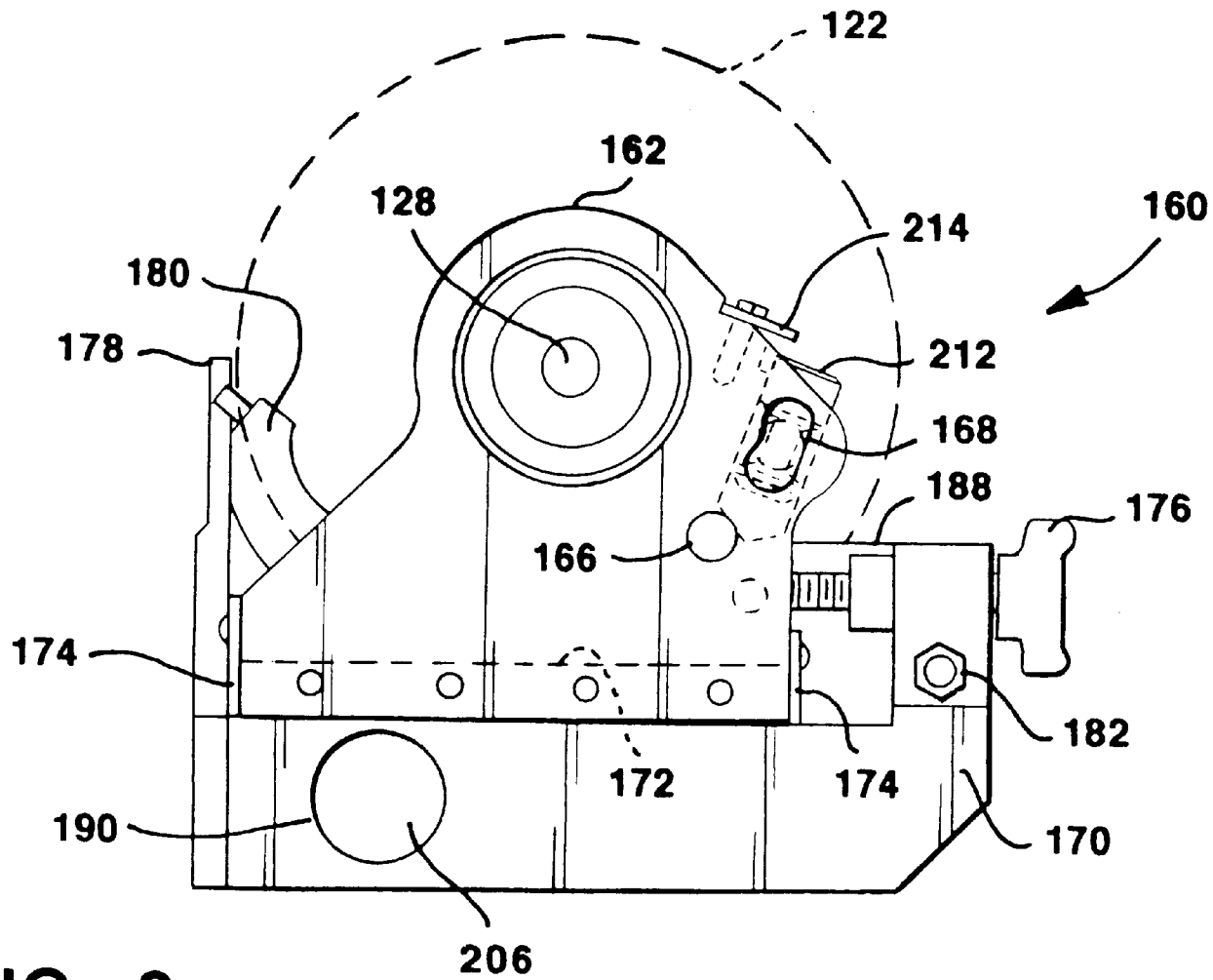
FIG. 8 is a side view of the index/guide assembly alone.
Figure 9:
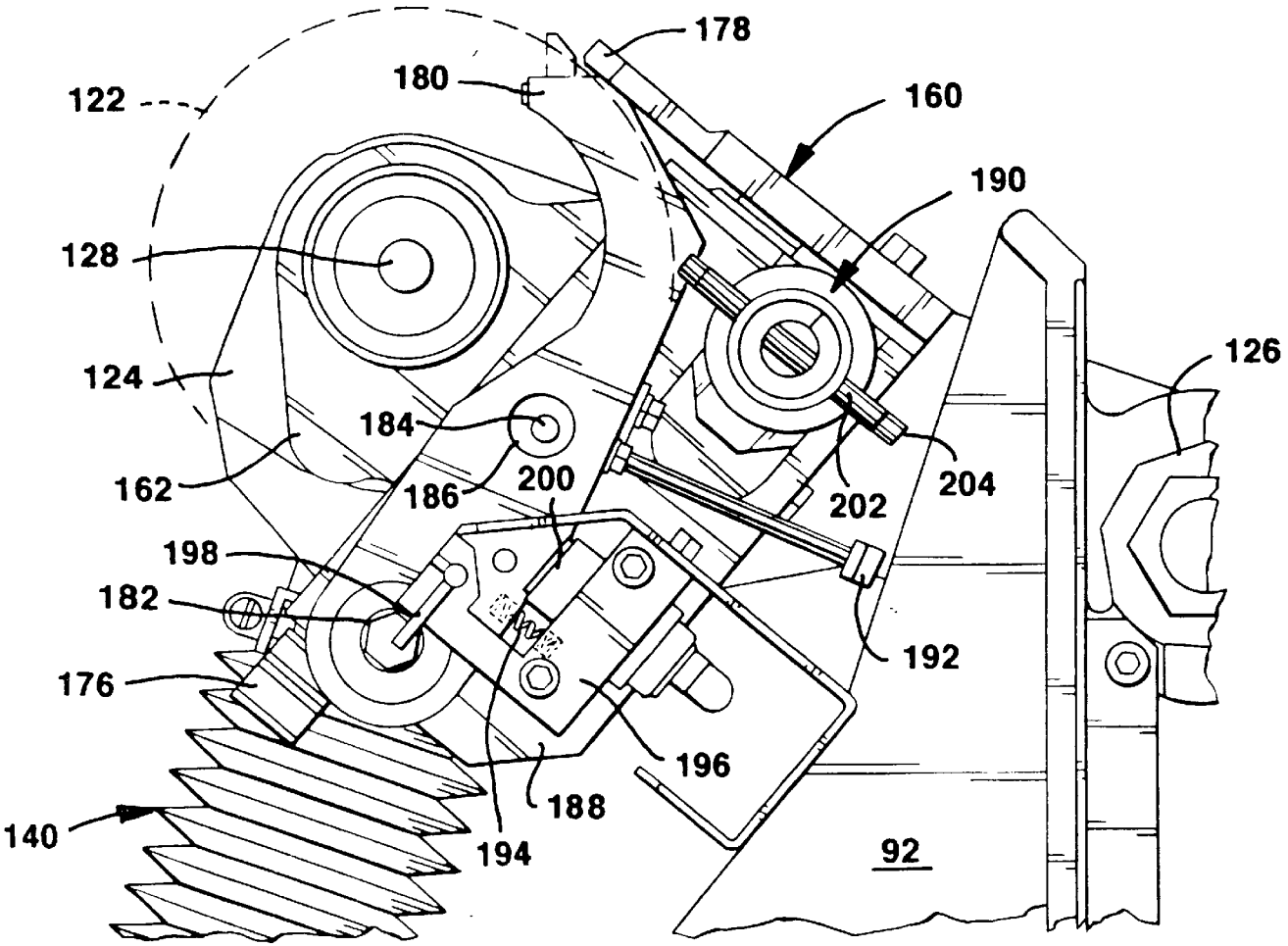
FIG. 9 is a side view of the other side of the index/guide assembly, in place on the grinding head.
Figure 10:
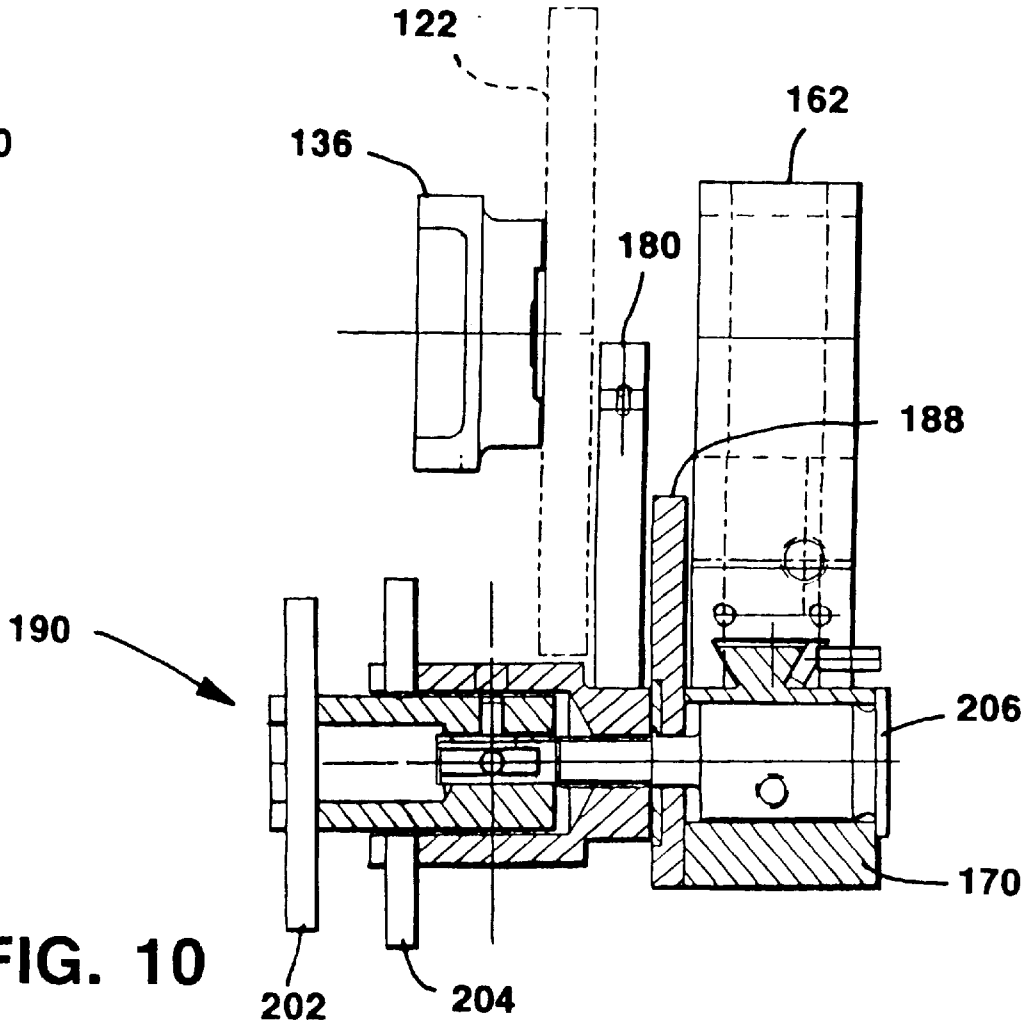
FIG. 10 is a cross sectional view of the eccentric clamp adjustment on the index/guide assembly.

Referring now to FIGS. 8, 9 and 10, the index/guide assembly 160 includes a housing 162 mounted on the grinding head 90 for movement toward and away from the mower reel 32. In particular, the housing 162 is mounted for pivotal movement about an axis coincidental with the axis of the grinding wheel 122. The index/guide assembly 160 can be selectively positioned as desired for spin grinding the entire reel or relief grinding the individual blades in the reel by means of a plunger pin 164 mounted on the housing 124 and holes 166 and 168 on the housing 162. Withdrawal and insertion of the plunger pin 164 in hole 166 locks the index/guide assembly 160 in an inoperative position out of engagement with the cutting reel 36 for spin grinding, while insertion into hole 168 corresponds with positioning into operative relationship with the blades for relief grinding.

A slide block 170 is mounted on the bottom of housing 162 by means of a dove tail groove connection 172 for linear movement in a transverse direction. Retainer plates 174 are secured on opposite sides of the housing 162 for limiting linear movement of the block relative to housing 162. Adjustment is accomplished by means of knob 176 connected through a screw as shown. Rotation of knob 176 adjusts the spacing between part of the index/guide assembly 160 and the grinding wheel 122, as will be explained more fully hereinafter.

On the other side of the index/guide assembly 160 there are provided a fixed guide finger 178 and an associated index stop finger 180, as best seen in FIG. 9. The guide finger 178 is secured at its lower end to the end of block 170 for movement therewith. The index finger 180 is coupled to a pivot 182 at the other end of block 170 for pivotal movement in a transverse plane adjacent to the upper end of the guide finger 178 about an axis parallel to the axis of the grinding wheel 122. The range of pivotal movement or stroke of the index finger 180 is defined by a pin 184 extending through an opening 186 in the index finger. The pin 184 is mounted on a plate 188 which is also coupled to pivot 182 between the index finger 180 and can thus pivot relative to block 170, but be secured in place as desired by an eccentric cam lock 190. An adjustment screw 192 is provided directly on the index finger 180 for further adjustment of its pivotal range or stroke.

The index stop finger 180 is normally biased away from the guide finger 178 by a spring 194. The spring 194 is disposed between the index finger 180 and a sensor block 196 secured to plate 188. A locking pin 198 is also provided on the sensor block 196 for cooperation with a hole (not shown) in the index finger 180 for selectively securing it in a retracted position toward the guide finger 178 in the spin grind mode. A proximity sensor 200 is also provided on the sensor block 196 for sensing positioning of the index finger 180.

It will thus be appreciated that the index/guide assembly 160 is specially adapted for compound adjustment in accordance with the particular configuration of the cutting reel 32 and blades therein being ground. Relative spacing between the grinding wheel 122 and guide finger 178 is adjusted by means of knob 176. Relative spacing between the index stop finger 180 and the fixed guide finger 178 is adjusted by means of the eccentric cam lock 190. The pivotal range or stroke of the index stop finger 180 is adjusted by means of knob 192. These comprise significant features of the present invention because they enable automatic indexing to the next blade in the relief grind mode of system 10.

The details of the eccentric cam lock 190 are best seen in FIG. 10. Cam lock 190 includes two handles 202 and 204. Handle 202 is secured to one end of an offset shaft 206 extending through a slot in plate 188. The other end of shaft 206 is journaled for rotation in the block 170. Handle 204 is threaded onto the shaft 206 between handle 202 and plate 188 for selectively clamping the plate in desired pivotal relation with block 170, as adjusted with handle 202. This in turn adjusts the spacing between the index stop finger 180 and the guide finger 178 to provide some free play behind the reel blade.

Figure 11:
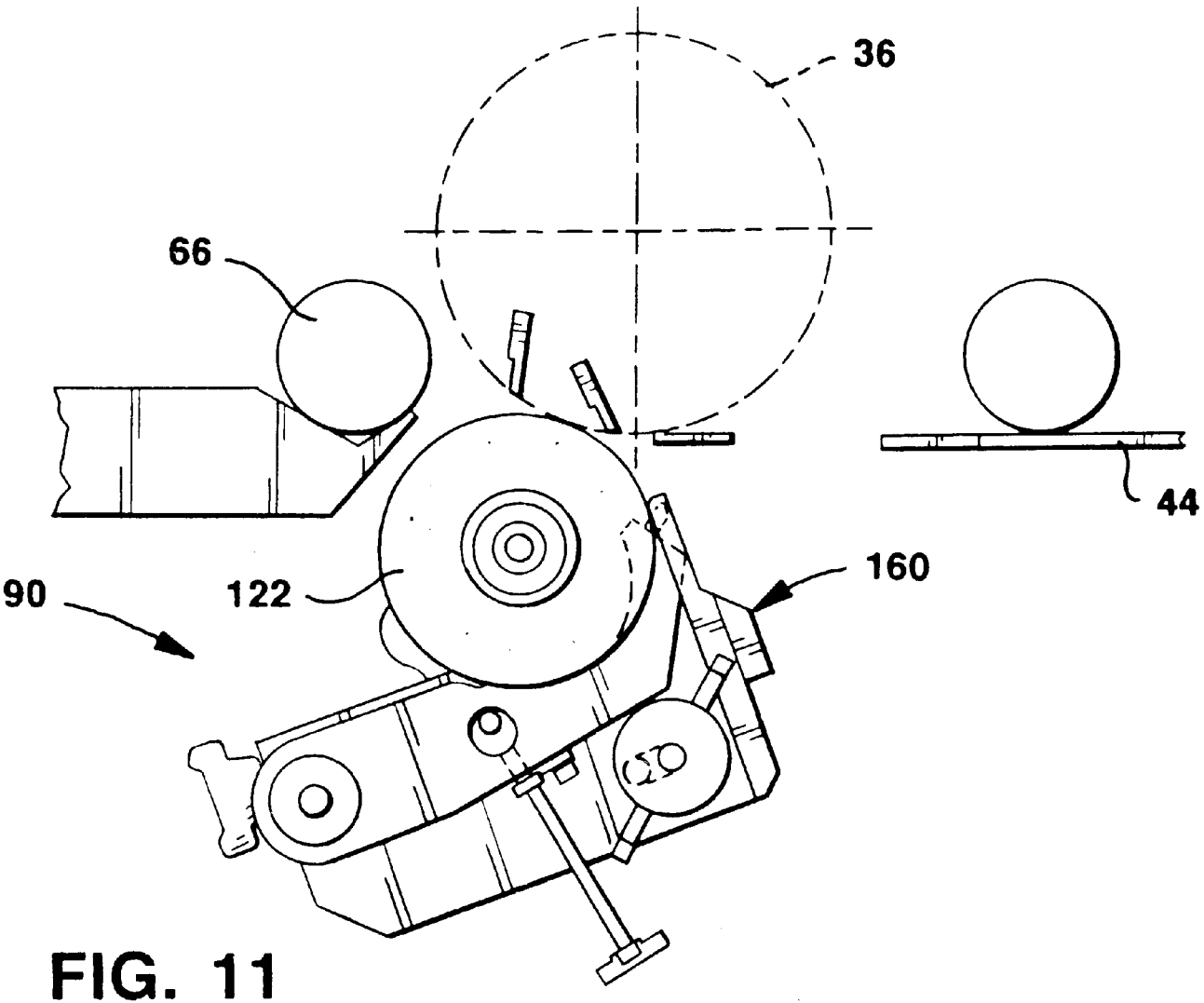
FIG. 11 is an illustration of the grinding head as positioned in the spin grind mode, with the index/guide assembly out of operative position.
Figure 12:
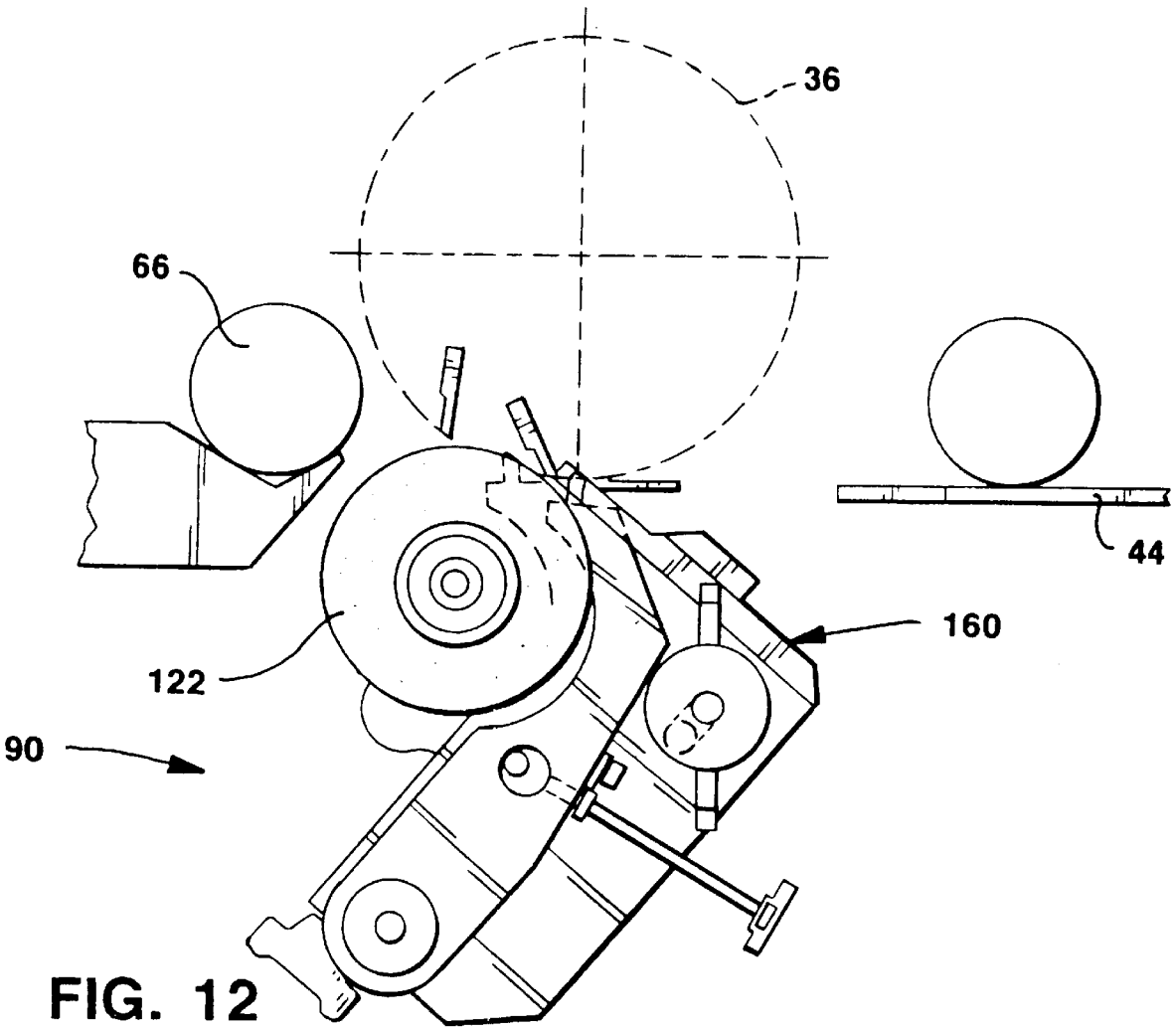
FIG. 12 is an illustration of the grinding head as positioned in the relief grind mode, with the index/guide assembly in operative position.

Referring now to FIGS. 11 and 12, system 10 operates as follows. After initialization and setup, the grinding head 90 reciprocates on carriage 92 and the drive 68 spins the cutting reel 36 until the ends of the blades have been spin ground to a true cylinder again. During the spin grind mode, the index/guide assembly 160 is located down and in an inoperative position so that fingers 178 and 180 do not interfere with the spinning cutting reel 36. The plunger pin 164 is seated in hole 166, and the index stop finger 180 is locked down against spring 194 by pin 198. FIG. 11 illustrates positioning of the grinding head 90 in the spin grind mode.

In the relief grind mode shown in FIG. 12, the index/guide assembly 160 is rotated up into an operative position and locked in place with knob 164 seated in hole 168 of housing 162. The guide finger 178 is adjusted as necessary to engage the trailing side or rear face of the first blade to be relief ground, as the spin drive 68 biases the cutting reel 36 counterwise towards the guide finger. Spacing between guide finger 178 and grinding wheel 122 is adjusted with knob 176. Spacing between the index stop finger 180 and guide finger 178 is adjusted with cam lock 190. The index finger 180 is adjusted relative to the rear face of the blade and its lateral end in order to guide that blade smoothly onto the beveled top of guide finger 178, and then catch the next blade after the grinding head 90 returns to the home position. The grinding head 90 starts at one end of the cutting reel 36 and travels along the blade towards the other end as grinding wheel 122 makes a relief grind on the trailing edge of the blade. Upon reaching the opposite end of reel 36, the index finger 180 pivots out from behind the blade into position to catch the next blade as the carriage 92 reverses direction and travels back to complete relief grinding of that blade. As carriage 92 returns to the home position, the guide finger 178 comes off the end of that blade, and the index finger 180 catches the next blade in the rotationally biased cutting reel 36 moving the index finger back against spring 194 as it is smoothly guided onto the guide finger 180 before starting the first pass of relief grinding the next blade. This continues sequentially until all blades in the cutting reel 36 have been relief ground.

Figure 13:
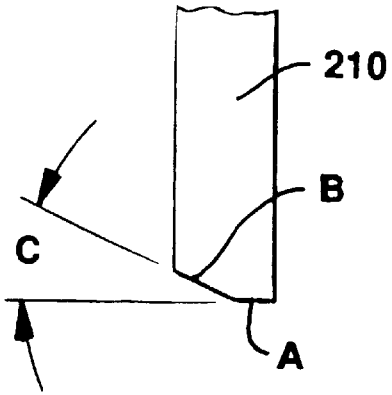
FIG. 13 is an end view of a blade after spin and relief grinding.

FIG. 13 illustrates the tip of a reel blade 210 having a sharpened cutting edge A after spin grinding, and a beveled trailing edge B at a relief angle C after relief grinding.

Referring again to FIG. 8, if desired, an adjustment can be provided for adjusting the relief angle C when locked in the operative position in the relief grind mode. A screw 212 with a circumferential surrounding groove for receiving the end of plunger pin 164 can be provided in housing 162 behind hole 168, which is elongate instead of round. Screw 212 is covered by a retainer 214 to avoid inadvertent disconnection. This provides for fine adjustment of the exact relief angle C after the index/stop assembly 160 has been positioned and locked in place.

From the foregoing, it will thus be appreciated that the present invention comprises an automatic mower cutting reel grinder having several advantages over the prior art. One significant advantage is that the automatic reel grinder herein incorporates a unique index/guide assembly for automatic indexing from blade to blade in the relief grind mode without further manual attention after initial setup. The index/guide assembly includes a pivotal index stop finger that receives the next blade and then guides it onto the guide finger for relief grinding. Another significant advantage is that the same grinding head is used for both spin and relief grinding. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. A method of automatically indexing a reel assembly having a plurality of reel blades, comprising:

(a) operably engaging a first reel blade with a first finger;

(b) translating the first finger relative to the first reel blade, whereby the first finger operably disengages from the first reel blade; and (c) rotating the reel assembly, whereby a second finger operably engages a second reel blade.

2. The method of claim 1, wherein the second finger positions the second reel blade for operable engagement by the first finger.

3. The method of claim 2, further comprising:

(d) translating the second finger relative to the second blade, whereby the second finger operably disengages from the second blade.

4. The method of claim 3, further comprising repeating acts (a)–(d), whereby the first finger sequentially engages and disengages from each reel blade in the plurality of reel blades.

5. The method of claim 1, further comprising:

attaching the first finger to a grinder carriage; and pivotally attaching the second finger to the grinder carriage in a predetermined spaced apart relationship with the first finger.

6. The method of claim 2, further comprising biasing the second finger away from the first finger.

7. The method of claim 1, further comprising moving the first finger and the second finger into and out of operative association with the reel blades.

8. The method of claim 1, configuring the first finger and the second finger such that the guide finger and the index finger do not operatively engage the blades of the cutting reel.

9. A method of sharpening a rotatable cutting reel having a plurality of reel blades, comprising:

(a) positioning an index finger in predetermined spaced apart relationship with a grinding wheel;

(b) rotating the rotatable cutting reel, whereby the index finger engages and guides a first reel blade into operable engagement with the grinding wheel; and (c) translating the index finger relative to the second reel blade, whereby the index finger disengages from the first reel blade.

10. The method of claim 5, further comprising grinding the first reel blade with the grinding wheel.

11. The method of claim 5, further comprising repeating acts (b)–(c) for each blade in the plurality of grinder blades.

12. The method of claim 5, further comprising:

moving the index finger into and out of operative association with the reel blades; and selectively securing the index finger in the desired position.

13. An automatic indexing apparatus for a mower reel grinder, the apparatus comprising:

(a) a first finger operably connected to a grinder carriage;

(b) a second finger pivotably operably connected to the grinder carriage; and (c) a bias element that biases the second finger away from the first finger;

whereby the second finger sequentially engages and then guides a reel blade into engagement with the first finger.

14. The automatic indexing apparatus of claim 10, further comprising a first drive that rotates the reel blade around an axis.

15. The automatic indexing apparatus of claim 11, further comprising a second drive that translates the first finger and the second finger relative to the relative blade.

16. The automatic indexing apparatus of claim 10, wherein the second finger is located between the grinding wheel and the first finger.

17. The apparatus of claim 13, wherein the bias element is a spring.

18. An automatic indexing mower reel grinder, comprising:

(a) an index finger adapted for movement between a first position and a second position;

(b) a first drive that rotates the mower reel, whereby a reel blade operably engages the index finger and biases the index finger into the first position;

(c) a second drive that translates the index finger along a length of the reel blade, whereby the index finger operably disengages from the reel blade; and (d) a spring that biases the index finger from the first position to the second position.

19. The grinder of claim 14, further comprising a guide finger adapted to receive the reel blade from the index finger.

20. The grinder of claim 14, wherein the mower reel comprises a plurality of reel blades and wherein the index finger sequentially operably engages each reel blade in the plurality of reel blades.

21. An automatic indexing mower reel grinder, comprising:

(a) an index finger adapted for movement between a first position and a second position;

(b) a first drive that rotates the mower reel, whereby a reel blade operably engages the index finger and biases the index finger into the first position;

(c) a second drive that translates the index finger along a length of the reel blade, whereby the index finger operably disengages from the reel blade; and (d) a bias element that biases the index finger from the first position to the second position.

22. The apparatus of claim 18, further comprising a index/guide assembly support adapted to allow the index/guide assembly to move between a relief grind position and a spin grind position, wherein the guide finger and the index finger are brought into and out of operative association with the blades of the cutting reel, respectively.

23. The apparatus of claim 18, wherein the index/guide assembly further comprises an adjustor adapted to allow relative motion between the guide finger and the grinding wheel.

24. The apparatus of claim 18, wherein the bias element is a spring.

25. An apparatus of grinding blades in a rotatable cutting reel of a mowing unit, the apparatus comprising:

(a) a grinding head including a rotatable grinding wheel;

(b) a first drive adapted to rotate of the grinding wheel on said grinding head;

(c) an index/guide assembly positioned in predetermined spaced apart relationship with said grinding head, said index/guide assembly including a guide finger, an index stop finger, and a housing that moveably supports the index stop finger in a spaced apart relationship with the guide finger; and (d) a bias element adapted to bias the index stop finger away from the guide finger of said index/guide assembly, whereby the index stop finger sequentially engages and then guides each blade in the rotatable cutting reel into slideable engagement with the guide finger during relative longitudinal movement between said grinding head and the cutting reel.

26. The apparatus of claim 21, wherein the index/guide assembly is adapted to allow the guide finger and the index finger to be positioned out of operative engagement with the blades during spin grinding.

* * * * *

UNITED STATES PATENT AND TRADEMARK OFFICE

CERTIFICATE OF CORRECTION

PATENT NO. : 6,290,581 B1 
DATED : September 18, 2001
INVENTOR(S) : Dieck et al.

It is certified that error appears in the above-identified patent and that said Letters Patent is hereby corrected as shown below:

Column 7,
Line 51, please delete “2” and insert -- 5 -- therefor.

Column 8,
Line 4, please delete “5” and insert -- 9 -- therefor.
Line 6, please delete “5” and insert -- 9 -- therefor.
Line 8, please delete “5” and insert -- 9 -- therefor.
Line 22, please delete “10” and insert -- 13 -- therefor.
Line 25, please delete “11” and insert -- 14 -- therefor.
Line 28, please delete “10” and insert -- 13 -- therefor.
Line 43, please delete “spring” and insert -- bias element -- therefor.
Line 45, please delete “14” and insert -- 18 -- therefor.
Line 47, please delete “14” and insert -- 18 -- therefor.
Lines 51-62, please delete the entire claim and replace with allowed claim 39 which reads as follows:

-- 21. An apparatus for grinding blades in a rotatable cutting reel of a mowing unit, the apparatus comprising:

(a) a grinding head including a rotatable grinding wheel;

(b) a first drive adapted to rotate of the grinding wheel on said grinding head;

(c) an index/guide assembly positioned in predetermined spaced apart relationship with said grinding head, said index/guide assembly including a guide finger, an index stop finger, and a housing that moveably supports the index stop finger in a spaced apart relationship with the guide finger; and (d) a bias element adapated to bias the index stop finger away from the guide finger of said index/guide assembly, whereby the index stop finger sequentially engages and then guides each blade in the rotatable cutting reel into slideable engagement with the guide finger during relative longitudinal movement between said grinding head and the cutting reel. --

Line 63, please delete “18” and insert -- 21 -- therefor.

UNITED STATES PATENT AND TRADEMARK OFFICE

CERTIFICATE OF CORRECTION

PATENT NO. : 6,290,581
DATED : September 18, 2001
INVENTOR(S) : Dieck et al.

It is certified that error appears in the above-identified patent and that said Letters Patent is hereby corrected as shown below:

Column 9,
Line 4, please delete "18" and insert -- 21 -- therefor.
Line 10 through column 10, line 10, please delete the entire claim and replace with the allowed claim 42 which reads as follows:

-- 25. An apparatus for automatic relief grinding of a plurality of blades in a rotatable cutting reel of a mowing unit, the apparatus comprising:

(a) a clamp adapted to support a cutting reel for rotation about an axis;

(b) a grinding head including a rotatable grinding wheel;

(c) a first drive adapted to rotate the grinding wheel on said grinding head;

(d) a second drive adapted to rotate the rotatable cutting reel around the axis;

(e) a third drive adapted to translate the grinding head in a direction substantially parallel to the axis of the cutting reel;

(f) an automatic indexing assembly positioned in predetermined spaced apart relationship with said grinding head, said automatic indexing assembly including a stop finger, an index finger, and a housing that moveably supports the index finger in a predetermined spaced apart relationship with the stop finger;

(g) a bias element adapted to bias the index finger away from the stop finger; and (h) an adjustor associated with the housing and adapted to position the stop finger relative to the grinding wheel;

whereby the index finger sequentially engages each blade in the rotatable cutting reel. --

Signed and Sealed this

Twenty-seventh Day of August, 2002

*Attest:*

*Attesting Officer*

JAMES E. ROGAN
*Director of the United States Patent and Trademark Office*